US006260698B1

(12) United States Patent
Delost et al.

(10) Patent No.: US 6,260,698 B1
(45) Date of Patent: Jul. 17, 2001

(54) ASSEMBLY OF PACKAGED BAND-SHAPED ARTICLES

(75) Inventors: Andrew J. Delost, Goose Creek; Timothy Lee Gerken, Moncks Corner, both of SC (US)

(73) Assignee: The Gates Corporation, Denver, CO (US)

( * ) Notice: Subject to any disclaimer, the term of this patent is extended or adjusted under 35 U.S.C. 154(b) by 0 days.

(21) Appl. No.: 09/332,785

(22) Filed: Jun. 14, 1999

(51) Int. Cl.[7] ..... B65D 85/02
(52) U.S. Cl. ..... 206/303; 206/410
(58) Field of Search ..... 206/303, 410, 206/471, 702, 497; 150/154, 157

(56) References Cited

U.S. PATENT DOCUMENTS 2,690,253 * 9/1954 Francois ..... 206/303
2,955,738 * 10/1960 Bacchus et al. ..... 206/303
3,018,883 * 1/1962 Wohlforth ..... 206/303
3,216,565 * 11/1965 Davis et al. ..... 206/303
3,952,872 * 4/1976 Consiglio, Jr. ..... 206/526
5,485,711 1/1996 Suzuki et al. .
5,632,439 * 5/1997 Yucknut et al. ..... 206/497

* cited by examiner

*Primary Examiner*—David T. Fidei
(74) *Attorney, Agent, or Firm*—M. S. Olson, Esq.; C. H. Castleman, Esq.; S. G. Austin, Esq.

(57) ABSTRACT

Assemblies of packaged band-shaped articles, such as industrial- or automotive belts, and a method for their manufacture are provided. The assembly comprises at least one such band-shaped article, each said article having an inner periphery and an outer periphery; and a pliable container having a first aperture or gap at a first end and a second aperture or gap at a second end, the second end being preferably in generally opposing relation to the first with respect to its location on the container. At least a significant number of the band-shaped articles are aligned with one another, and are aligned with at least one of the two pliable container apertures. At least a portion of the inner surface of the pliable container is in generally opposing relation to the outer periphery of one or more of the band-shaped articles, and at least another portion of the inner surface of the pliable container is in opposing relation to the inner periphery of one or more of the band-shaped articles to maintain the articles in general alignment with another.

8 Claims, 2 Drawing Sheets

ASSEMBLY OF PACKAGED BAND-SHAPED ARTICLES

BACKGROUND OF THE INVENTION

The present invention relates to assemblies of packaged or containerized belts or other band-shaped articles, as well as to a method for packaging such assemblies. The invention more particularly pertains to a method for packaging band-shaped articles including belts in a pliable container which substantially eliminates twisting, crimping and tangling of such articles, even when several hundred or more are packaged within a single such package.

Band-shaped articles, including industrial and automotive belts and belting, rubber bands, looped lengths of hose or tubing, o-rings, etc., are frequently packaged together in large number for shipment and/or storage. In such cases, it is frequently desirable that such articles not become entangled with one another, so that further handling is not required and the articles' integrity is not compromised.

Industrial and automotive belts and belting, including synchronous or toothed belts, V-shaped belts, multi-V-ribbed belts and flat belting, are frequently packaged in bags for storage or for shipment from, e.g., a belt manufacturer to a customer's assembly or sales site. Depending in part on the type of belt and its intended application, it is not uncommon for dozens or even several hundred of such belts to be bundled together in a single package. The belts are commonly placed loosely within a sealed or unsealed polypropylene bag, which is then typically placed within a suitably sized and shaped paperboard box for shipment and/or storage without further restraining means.

A problem arises in the packaging of such industrial and/or automotive belts and other band-shaped articles packaged in this manner. Particularly when large numbers of belts, e.g., a hundred or more, are bundled together within a single package, the nature of the bag system frequently results in entanglement of one belt with another, since the belts are not prevented or restrained from shifting or otherwise moving about within the bag.

Such belts and other band-shaped articles may moreover include one or more reinforcement cords which may be wrapped on or about the articles in a helical configuration or other form as is well known in the relevant art. Such reinforcement tends to force the belt at rest to twist upon itself in a "figure-eight"-type configuration. When a number of such belts are packaged together in a single container and twist upon themselves in this manner, they frequently take on a permanent set, i.e., a deformation which does not disappear when the external force which caused it is removed. Such permanent set in an elastomeric belt may lead to premature belt failure. The belts packaged according to this method may moreover become crimped due to the weight placed upon them while in this twisted configuration by the other belts. Such crimping may also lead to premature belt failure.

Attempts at improving belt packaging techniques and similar techniques for other band-shaped articles have not been completely successful. One such attempt involves the use of a compartmentalized paperboard box in lieu of the aforementioned plastic bag. According to this method, the belts are laid in the box and are held by the compartment walls in a certain configuration which prevents the belts from twisting upon themselves. For some applications however, this method may prove unsatisfactory in that dust from the paperboard box may fall onto the belts. For these applications, such assemblies may require the additional labor step and concomitant cost of removing the dust from the belts prior to further use. Moreover, this method involves the additional labor steps of assembling the individual compartments within each box. This may be unfavorable in manufacturing settings where production rates are generally of interest.

Thus it would be advantageous to develop an assembly of packaged band-shaped articles, including industrial- or automotive belts such as power transmission belts, which is easily and inexpensively constructed and which is not marked by the pronounced deposition of dust or other extraneous debris on the contents.

It would moreover be advantageous to develop such assembly in which the packaged contents would experience a reduced incidence of entanglement, twisting, undesirable permanent set and/or crimping.

It would furthermore be desirable to develop a process for forming such assemblies of packaged band-shaped articles which would reduce entanglement of such articles compared to prior art methods.

It would also be desirable to develop such a process for packaging band-shaped articles such as belts and belting for storage and/or shipment, which process would be simple, would substantially reduce belt tangling and crimping while in the package compared to prior art methods, and which would reduce the incidence of undesirable permanent set in belts and other articles packaged in this manner.

It would moreover be desirable to develop such a method which would reduce the possibility of contamination by dust or other extraneous matter on the surface of the articles packaged according to such method.

Accordingly, it is a primary object of the invention to provide an assembly comprising a plurality of band-shaped articles, such as belts, which maintains the articles within a generally fixed alignment with respect to one another, and, in a preferred embodiment, which substantially eliminates twisting and the concomitant tangling and crimping of such goods while in the package, and thereby substantially reduces the incidence of undesirable permanent set of the articles due to such activity.

It is a further object of the invention to provide such an assembly which exhibits significantly reduced incidence of dust- or other extraneous matter deposition onto the surface of the goods contained therein.

It is yet another object of the invention to provide a process for forming the above-noted assemblies.

SUMMARY OF THE INVENTION

To achieve the foregoing and other objects and in accordance with a purpose of the present invention as embodied and broadly described herein, an assembly of packaged band-shaped articles, such as industrial- or automotive belts is provided. The assembly comprises at least one such band-shaped article, each said article having an inner periphery and an outer periphery; and a pliable container having a first aperture or gap at a first end and a second aperture or gap at a second end, the second end being preferably in generally opposing relation to the first with respect to its location on the container. The pliable container moreover includes an inside surface and an outside surface.

At least a significant number of the band-shaped articles are similarly aligned, and are aligned with at least one of the two pliable container apertures. At least a portion of the inner surface of the pliable container is in generally opposing relation to the outer periphery of one or more of the band-shaped articles, and at least another portion of the inner surface of the pliable container is in opposing relation to the inner periphery of one or more of the band-shaped articles to form an annular- or ring-shaped package. In a preferred embodiment, the annular package is optionally set within a second container, preferably more rigid than the pliable container, and of suitable dimension and shape to facilitate shipment and storage.

In another embodiment, a process for packaging band-shaped articles is provided, comprising the steps of placing the articles within a pliable container having a first aperture at a first end thereof and a second aperture at a second end thereof; arranging the articles within the container so that at least one of the band-shaped articles is located between the apertures; and directing a portion of the container's second end including the second aperture past the inner periphery of at least one of the band-shaped articles to a point near the first aperture. The package thus formed maintains the band-shaped articles in a generally fixed alignment with respect to one another, and thus substantially reduces twisting of the articles upon themselves, entanglement among articles, and crimping of tangled articles. It thereby reduces the possibility of unwanted permanent set in elastomeric articles packaged in this manner.

In a further embodiment, a method for packaging automotive and/or industrial belts and belting is provided incorporating these steps. An advantage is realized when such belts are relatively long and/or relatively thin, whereby, in the absence of the present invention, these belts' unrestrained tendency to twist upon themselves in a figure eight type configuration is particularly acute.

In a further embodiment, the pliable container containing the band-shaped articles which may or may not be belts or belting, is placed within a second container which is preferably rigid, to facilitate stacking of multiple such packages for storage and/or shipment.

BRIEF DESCRIPTION OF THE DRAWINGS

The accompanying drawings which are incorporated in and form a part of the specification illustrate preferred embodiments of the invention, and together with a description, serve to explain the principles of the invention. In the drawings.

DETAILED DESCRIPTION

Figure 1:
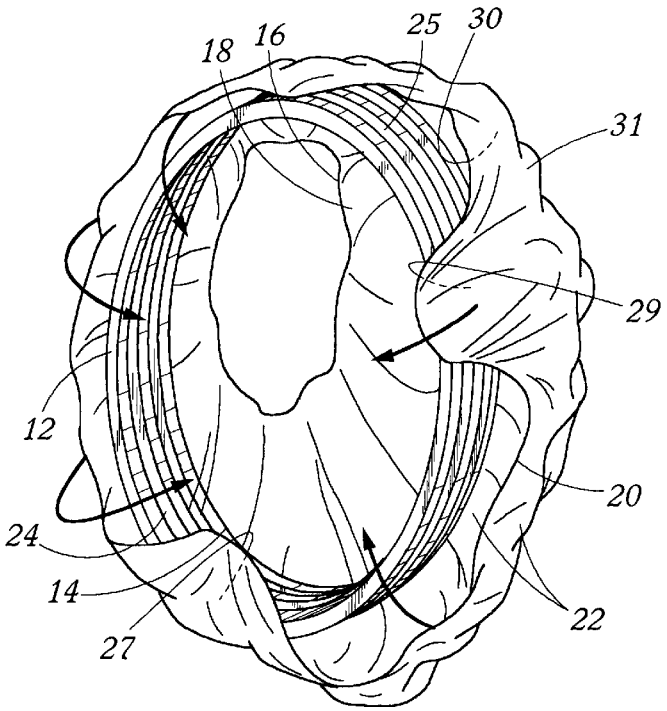
FIG. 1 is a perspective view of a pliable container and a plurality of band-shaped articles, illustrating a step of a preferred method of the present invention.
Figure 2:
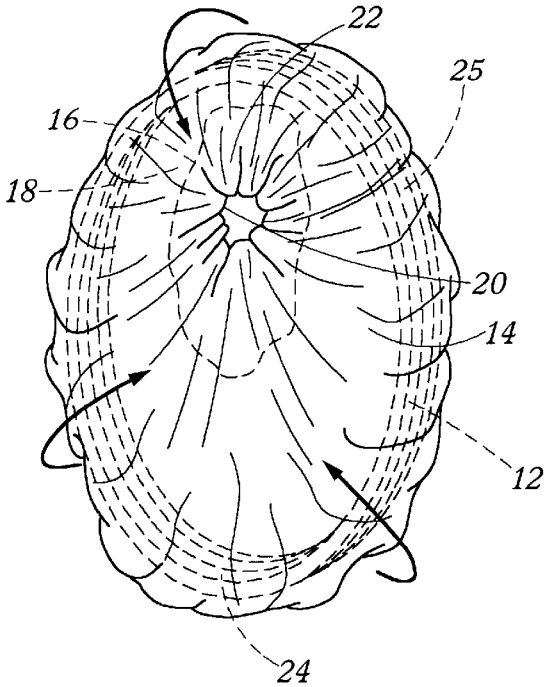
FIG. 2 is a perspective view of a pliable container and a plurality of bands, illustrating another step of a preferred method of the present invention.
Figure 3:
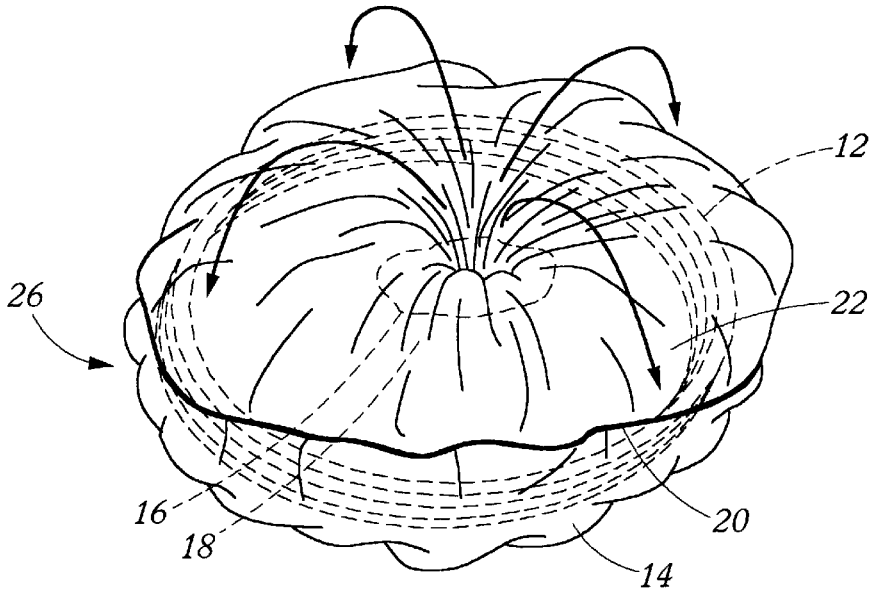
FIG. 3 is a perspective view of a pliable container and a plurality of bands, illustrating an additional step of a preferred method of the present invention.

FIGS. 1–3 illustrate steps of a process for packaging band-shaped articles according to a preferred embodiment of the present invention. Referring to FIG. 1, a plurality of band-shaped articles 12, in this case, in the form of elongate power transmission belts, are shown resting within a pliable container 14 having a first aperture 16 at a first end 18 thereof and a second aperture 20 at a second end 22 thereof. As can be seen from the drawing, the band-shaped articles 12 are arranged within the container 14 so that at least one, but preferably most, of the band-shaped articles 12 are located between the apertures 16, 20. As seen in the subsequent step of the preferred method of the present invention as shown in FIG. 2, a portion of the second end 22 of the container 14 is then pulled past the inner periphery 24 of at least one of the band-shaped articles 12 in the direction indicated by the arrow, to a point proximal the first end 18, such that the second aperture 20 passes through the aforesaid inner periphery 24 to a point near the first end 18.

In a subsequent step of the preferred method as shown in FIG. 3, a portion of the second end 22 of the container 14 containing the second aperture 20 is pulled or directed through the gap formed by the first aperture 16, as shown, to form a generally ring-shaped or annular package 26, having a portion of the pliable container 14 extending beyond the annular package 26 on the container's first end 18. According to this embodiment, the first aperture 16 is preferably smaller than the second aperture 20, which facilitates the formation of the annular package 26 when the container is manipulated in the aforesaid manner.

Figure 4:
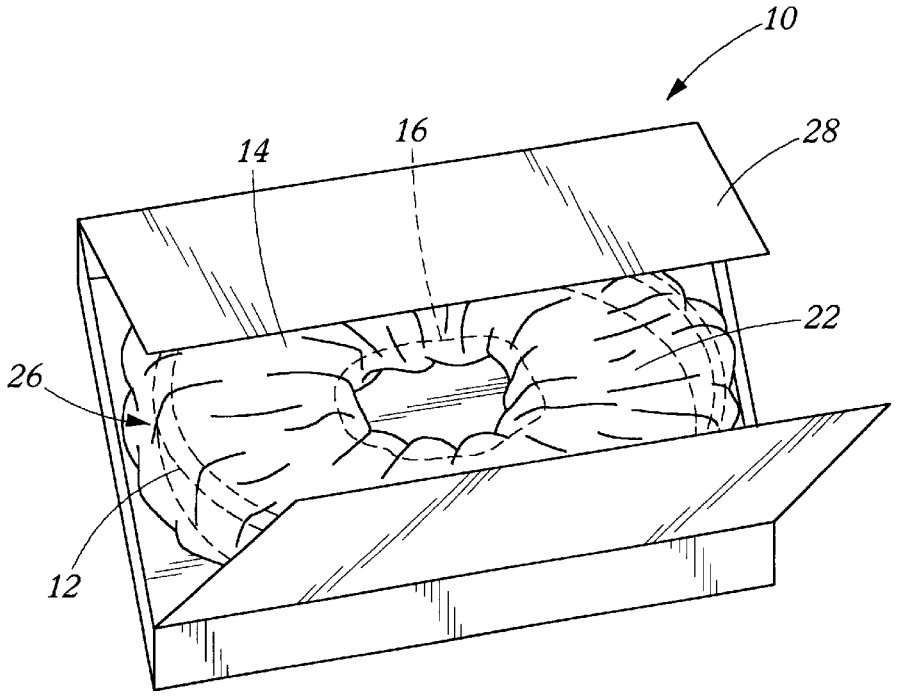
FIG. 4 is perspective view of a preferred embodiment of the present invention in the form of an assembly comprising a plurality of belts packaged according to a preferred method of the present invention.

As shown in FIG. 4, the thus-formed assembly of packaged band-shaped articles 26 may optionally be further containerized within a suitably-shaped and sized second container 28 for shipping and/or storage purposes. Such container 28 is preferably a suitably-shaped and sized paperboard box, as indicated in FIG. 4.

In a preferred embodiment of the present invention, a process for packaging band-shaped articles comprises the steps of: (1) placing the articles 12 within a pliable container 14 having a first aperture 16 at a first end 18 thereof and a second aperture 20 at a second end 22 thereof; (2) arranging the articles 12 within the container 14 so that at least one of the band-shaped articles 12 is located between the apertures 16, 20; (3) reaching through the container 14 from the first aperture 16 to any suitable point proximal the second aperture 20; (4) grasping at least a portion 21 of the second end 22 of the container 14 proximal the second aperture 20; and (5) pulling that portion 21 of the second end 22 through the inside of the container 14 so that it passes along-side or past the inner periphery 24 of at least one of the band-shaped articles 12 to some suitable point proximal the first aperture 16, to form a ring-shaped or annular package of band-shaped articles.

For use in the present invention, the pliable container 14 may be formed of any suitable material, including plastics, suitably treated and manipulated natural and synthetic fibers, and metals, and may have any suitable shape depending on the configuration of its intended contents. In a preferred embodiment directed to its use in packaging automotive and industrial belts, the container is preferably formed of a suitable plastics film such as one formed of polypropylene, and has a wall gauge of preferably from about 1 to about 10 mil (0.02 to 0.25 mm), more preferably from about 2 to about 8 mil (0.05 to 0.2 mm), and most preferably from about 3 to about 5 mil (0.08 to 0.1 mm).

The container may be formed according to any suitable method well known to the art. In a preferred embodiment, a plastic film for example, may be suitably heat sealed in the appropriate areas to form a bag having at least two apertures, one being located roughly at each of two generally opposite ends of the bag. According to other examples, a textile fabric may be sewn or woven into a suitable configuration, or a metal foil may be suitably formed or welded.

The apertures 16, 20 of the container 14 may preferably be suitably sized so that at least one allows for entry of the articles, and at least one allows for the passage of some element or means therethrough for grasping of the opposite end and/or directing the other end of the bag therethrough. The apertures 16, 20 may be of any suitable dimension; they may encompass an area equivalent to the container ends 18, 22 at which they are located, as where the pliable container is in the form of an open-ended tube or cylinder for example. They may however be much smaller, and may be of the same size or of different sizes. In a preferred embodiment, either one of the apertures is selected to be at least somewhat smaller than the other, so that when the opposite end is pulled to a point proximal thereto or through the aperture, a tight fit between that smaller aperture and the portion of the bag pulled therethrough is readily accomplished. This phenomenon is illustrated in FIGS. 3 and 4.

The apertures 16, 20 may be formed in the container according to any suitable method, including punching a hole with one's fingers in opposite ends of a heat-sealed polypropylene film or aluminium foil bag. The apertures may optionally include reinforced edges which may be accomplished by the addition of a suitable material about their periphery, or by stitching the edges as appropriate. The latter options present the possibility of using the bags multiple times, thereby decreasing waste and potentially decreasing costs.

In a preferred embodiment, and as shown in FIG. 4, that portion of the second end 22 which has been pulled past the inner periphery 24 of the articles 12 to a point proximal the first aperture 16 is moreover preferably pulled through the first aperture 16. As seen in the relevant figures, pulling the second end of the container through the band-shaped articles and up to the first aperture, forms a somewhat annular or ring-shaped package, wherein the band-shaped articles are prevented from twisting upon themselves by the presence of that portion of the container which passes through their inner periphery. This ring-shaped structure is however more pronounced, and stability of the articles correspondingly increased within the package, when the second end is pulled more-or-less entirely through the first aperture, as shown in FIG. 4.

According to a further preferred embodiment as shown in FIGS. 3 and 4, that portion of the container's second end 22 including the second aperture 20, which is pulled past the inner periphery of the articles 24 and through the first aperture 16 is then spread open and allowed to lie against the ring-shaped package 26, as shown. This optional step provides still greater stability to the ring-shaped package. It is believed that, with proper elasticity and/or pliable container length, one could then repeat the process of pulling this second end 22 past the inner periphery of the articles 24 and through the first aperture 16 to form a multiple-layered ring-shaped package (not shown). This may be desirable for example in some instances where the ring-shaped package would define the final package for shipment and/or storage, or where greater stability of the ring-shaped package was desired.

In a further preferred embodiment also illustrated in FIG. 4, the ring-shaped package 26 formed according to the steps set forth above is then placed into a suitably sized, shaped and constructed second container 28 which is preferably at least more rigid than the pliable container described above. This second container 28 may be formed of any suitable material including plastics, metals and natural and synthetic fibers, including cellulose fibers, which have been suitably treated and manipulated according to known methods not a part of the present invention. In a preferred embodiment as shown, this second container 28 comprises a suitable paperboard material of an appropriate construction. The addition of this second rigid container 28 facilitates stacking of the containers for shipment or storage, and provides additional protection to the contents from contamination or damage from environmental elements.

FIG. 4 furthermore illustrates a preferred embodiment of the invention in the form of an assembly of packaged band-shaped articles, shown generally 10. The assembly of articles 10, such as industrial- or automotive belts comprises at least one such band-shaped article 12, each said article, as shown in FIG. 1, having an inner periphery 24 and an outer periphery 25; and a pliable container 14 as described above, having a first aperture 16 or gap at a first end 18 and a second aperture 20 or gap at a second end 22, the second aperture 20 being preferably in generally opposing relation to the first 16 with respect to its location on the container 14 itself. As can be seen in FIG. 1, the pliable container moreover includes an inside surface 30 and an outside surface 31.

At least a significant number of the band-shaped articles 12 are aligned with one another as shown in the figures, and are moreover aligned with at least one of the two pliable container apertures, as shown. This alignment of the band-shaped articles with at least one of the apertures allows for passage of the opposing end of the container through the inner peripheries of the articles, and, in a preferred embodiment, through the opposing aperture, to form the resultant annular or ring-shaped package 26.

In forming the annular package 26, at least a first portion 29 of the inner surface 30 of the pliable container 14 is preferably in generally opposing relation to the outer periphery 25 of one or more of the band-shaped articles 12, and at least a second portion 27 of the inner surface 30 of the pliable container 14 is in opposing relation to the inner periphery 24 of one or more of the band-shaped articles 12. In a preferred embodiment, the annular package 26 is placed within a second container 28, preferably in the form of a suitable paperboard box, as shown.

The annular package 26 may optionally be wrapped or bound with a suitable band (not shown) to further secure the belts or other band-shaped articles. Such band may be of any conventional and/or suitable material, such as rubber, plastic, fiber or metal, and may be of any conventional and/or suitable form, e.g., strip, braid or cord. The band may be directed through both apertures and then about the annular package, and secured as by tying, knotting, application of adhesive, stapling, The present invention provides an assembly of packaged band-shaped articles including automotive and/or industrial belts or belting, which may be easily and inexpensively manufactured; which utilizes conventional materials, or materials easily modified for such purpose, e.g., holes punched or formed in the opposite ends of plastic bags; which essentially eliminates the incidence of extraneous matter deposition and concomitant additional labor steps; and which successfully addresses the entanglement, undesirable permanent set and crimping problems associated with reinforced belt packaging configurations and methods of the prior art. It is moreover believed that while each of the aforementioned process steps can readily be performed manually, any or all such steps would be readily adaptable to automated process, as one skilled in the art would appreciate.

An advantage is realized when relatively long and/or relatively thin articles such as certain industrial belts, are packaged according to the provisions of the present invention. Such belts may for example have a circumference of from 90 to 95 cm or more, a thickness of from 0.01 to 0.03 cm or less, and a width of from only about 4 to 5 mm, and may be toothed along one or both of the inner and outer surfaces. These and similar belts exhibit a very strong tendency to undergo two different twists when not otherwise restrained, by virtue of their various disparate proportions, thus taking on a pronounced figure-eight configuration. The present invention essentially eliminates the relatively high failure rate of such belts, which had previously been attributable to the high incidence of crimping, etc., during shipment and storage.

For utilization with the aforementioned toothed belts, applicants have advantageously utilized a 4 mil (0.10 mm) polypropylene bag of substantially rectangular cross-section, which was about 33 cm wide, about 61 cm long, which included a pleat measuring about 11.4 cm on each side, and was heat sealed on opposing ends, leaving a suitable aperture at each such end.

Although the present invention has been described in detail for the purpose of illustration, it is to be understood that such detail is solely for that purpose and that variations can be made therein by one skilled in the art without departing from the spirit or scope of the present invention except as it may be limited by the claims. The invention disclosed herein may suitably be practiced in the absence of any element which is not specifically disclosed herein.

What is claimed is:

1. An assembly of packaged band-shaped articles, comprising:

(a) a plurality of said band-shaped articles, each said article having an inner periphery and an outer periphery; and (b) a pliable container containing said band-shaped articles, said pliable container being formed essentially of a pliable film and having a first aperture at a first end and a second aperture at a second end, an inside surface and an outside surface;

wherein at least a first portion of the inner surface of the pliable container is in generally opposing relation to the outer periphery of one or more of the band-shaped articles, and at least a second portion of the inner surface of the pliable container is in opposing relation to the inner periphery of one or more of the band-shaped articles to form an annular package.

2. The assembly of claim 1 further comprising a second container, said annular package being located within said second container.

3. The assembly of claim 2 wherein said second container is a box formed of a material selected from the group consisting of;

a) plastics;

b) cellulose; and c) metal.

4. The assembly of claim 1 wherein said pliable container is formed of a material selected from the group consisting of:

a) plastics;

b) textile fabrics; and c) metals.

5. The assembly of claim 4 wherein said container is formed of a polypropylene film having a thickness of from about 3 mil to about 5 mil.

6. The assembly of claim 1 wherein said first aperture is smaller than said second aperture.

7. The assembly of claim 1 wherein said band-shaped articles are selected from the group consisting of:

(a) automotive belts and belting;

(b) industrial belts and belting;

(c) lengths of hose or tubing;

(d) rubber bands; and (e) O-shaped rings.

8. The assembly of claim 7 wherein said belts and belting are selected from the group consisting of:

(a) synchronous belts and belting;

(b) V-shaped belts and belting;

(c) multi-V-shaped belts and belting; and (d) flat belts and belting.

* * * * *